US009696681B2

(12) United States Patent
Imanaka

(10) Patent No.: US 9,696,681 B2
(45) Date of Patent: Jul. 4, 2017

(54) IMAGE FORMING APPARATUS INCLUDING BRUSH ROLLER THAT CHARGES PHOTOSENSITIVE DRUM AND REMOVES TONER REMAINING ON CIRCUMFERENTIAL SURFACE OF PHOTOSENSITIVE DRUM

(71) Applicant: KYOCERA Document Solutions Inc., Osaka (JP)

(72) Inventor: Yoshitaka Imanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/135,609

(22) Filed: Apr. 22, 2016

(65) Prior Publication Data

US 2016/0313691 A1 Oct. 27, 2016

(30) Foreign Application Priority Data

Apr. 24, 2015 (JP) ..... 2015-089311

(51) Int. Cl.

| | |
|---|---|
| ***G03G 15/22*** | (2006.01) |
| ***G03G 21/00*** | (2006.01) |
| ***G03G 15/02*** | (2006.01) |
| *G03G 21/08* | (2006.01) |

(52) U.S. Cl.
CPC ..... *G03G 21/0035* (2013.01); *G03G 15/0216* (2013.01); *G03G 21/08* (2013.01)

(58) Field of Classification Search
USPC ..... 399/107, 110, 115, 123, 130, 148
See application file for complete search history.

(56) References Cited

U.S. PATENT DOCUMENTS 4,469,435 A * 9/1984 Nosaki ..... G03G 15/0216 15/1.51

FOREIGN PATENT DOCUMENTS

JP 2014-081467 A 5/2014

* cited by examiner

*Primary Examiner* — Hoan Tran
(74) *Attorney, Agent, or Firm* — Studebaker & Brackett PC

(57) ABSTRACT

An image forming apparatus includes a photosensitive drum and a brush roller. The photosensitive drum has a circumferential surface on which a toner image is to be formed. The brush roller rotates while in contact with the circumferential surface of the photosensitive drum to charge the photosensitive drum. The brush roller removes toner remaining on the circumferential surface of the photosensitive drum.

10 Claims, 7 Drawing Sheets

IMAGE FORMING APPARATUS INCLUDING BRUSH ROLLER THAT CHARGES PHOTOSENSITIVE DRUM AND REMOVES TONER REMAINING ON CIRCUMFERENTIAL SURFACE OF PHOTOSENSITIVE DRUM

INCORPORATION BY REFERENCE

The present application claims priority under 35 U.S.C. §119 to Japanese Patent Application No. 2015-89311, filed Apr. 24, 2015. The contents of this application are incorporated herein by reference in their entirety.

BACKGROUND

The present disclosure relates to image forming apparatuses.

Image forming apparatuses have been known that include a brush roller that charges a photosensitive drum. In some of the image forming apparatuses, the brush roller rotates by following rotation of the photosensitive drum at a specific peripheral speed ratio. The brush roller of the image forming apparatus includes bristles each having a curved tip end portion inclined in a rotation direction of the brush roller relative to the base end of the bristles in order to uniformly charge the photosensitive drum.

SUMMARY

An image forming apparatus according to the present disclosure includes a photosensitive drum and a brush roller. The photosensitive drum has a circumferential surface on which a toner image is to be formed. The brush roller rotates while in contact with the circumferential surface of the photosensitive drum to charge the photosensitive drum. The brush roller removes toner remaining on the circumferential surface of the photosensitive drum.

DETAILED DESCRIPTION

Figure 1:
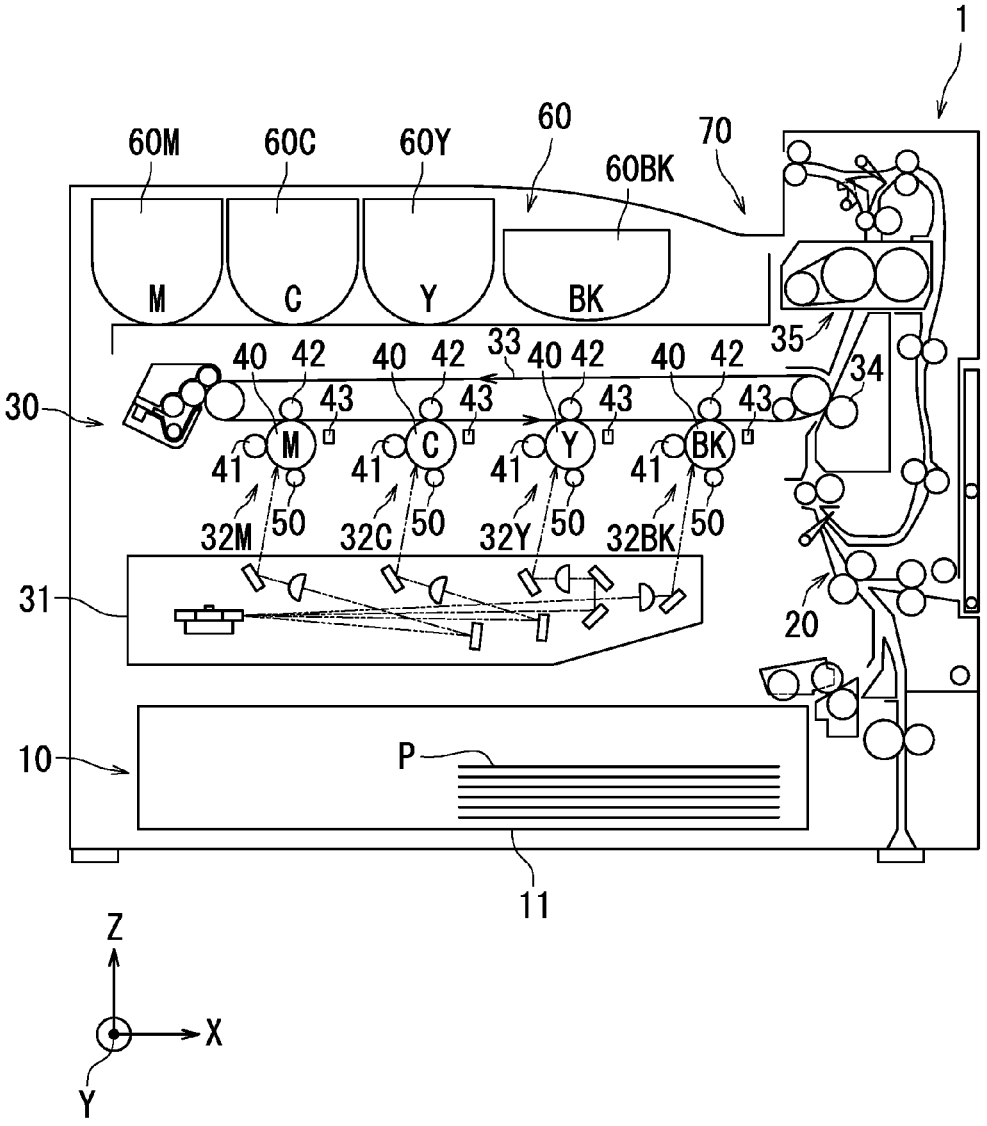
FIG. 1 is a side cross sectional view illustrating an image forming apparatus according to an embodiment of the present disclosure.

The following describes an embodiment of the present disclosure with reference to the accompanying drawings. It is noted that elements that are the same or equivalent are indicated by the same reference signs in the drawings and description thereof is not repeated. In the present embodiment, an X axis, a Y axis, and a Z axis are perpendicular to one another. The X axis and the Y axis are parallel to a horizontal plane. The Z axis is perpendicular to the horizontal plane.

An image forming apparatus 1 according to the present embodiment of the present disclosure will be described below with reference to FIG. 1. FIG. 1 is a side cross sectional view illustrating the image forming apparatus 1. The image forming apparatus 1 in the present embodiment is a full color printer, for example. The image forming apparatus 1 includes a feeding section 10, a conveyance section 20, an image forming section 30, a toner supplying section 60, and an ejection section 70. The feeding section 10 includes a cassette 11 that accommodates a plurality of sheets P. The feeding section 10 feeds the sheets P one at a time from the cassette 11 to the conveyance section 20. The sheets P may be sheets of paper or synthetic resin.

The conveyance section 20 conveys the sheet P to the image forming section 30. The image forming section 30 includes an exposure unit 31, a magenta image forming unit 32M, a cyan image forming unit 32C, a yellow image forming unit 32Y, a black image forming unit 32BK, an intermediate transfer belt 33, a secondary transfer roller 34, and a fixing unit 35.

The exposure unit 31 irradiates the magenta image forming unit 32M, the cyan image forming unit 32C, the yellow image forming unit 32Y, and the black image forming unit 32BK with laser light for forming images corresponding to image data. Through the above, the exposure unit 31 forms electrostatic latent images on the magenta image forming unit 32M, the cyan image forming unit 32C, the yellow image forming unit 32Y, and the black image forming unit 32BK. The magenta image forming unit 32M forms a magenta toner image based on the corresponding electrostatic latent image. The cyan image forming unit 32C forms a cyan toner image based on the corresponding electrostatic latent image. The yellow image forming unit 32Y forms a yellow toner image based on the corresponding electrostatic latent image. The black image forming unit 32BK forms a black toner image based on the corresponding electrostatic latent image. The toner images in the respective four colors are transferred to the outer surface of the intermediate transfer belt 33 in a superposed manner, thereby forming a color toner image. The secondary transfer roller 34 transfers the color toner image formed on the outer surface of the intermediate transfer belt 33 to the sheet P. The fixing unit 35 applies heat and pressure to the sheet P to fix the color toner image to the sheet P. Thereafter, the sheet P is ejected onto the ejection section 70.

The magenta image forming unit 32M, the cyan image forming unit 32C, the yellow image forming unit 32Y, and the black image forming unit 32BK each include a photosensitive drum 40, a development roller 41, a primary transfer roller 42, a charge eliminating lamp 43, and a brush roller 50.

The toner supplying section 60 includes cartridges 60M, 60C, 60Y, and 60BK. The cartridge 60M contains a magenta toner. The cartridge 60C contains a cyan toner. The cartridge 60Y contains a yellow toner. The cartridge 60BK contains a black toner. The cartridges 60M, 60C, 60Y, and 60BK supply the respective toners to the respective development rollers 41 of the magenta image forming unit 32M, the cyan image forming unit 32C, the yellow image forming unit 32Y, and the black image forming unit 32BK.

Figure 2:
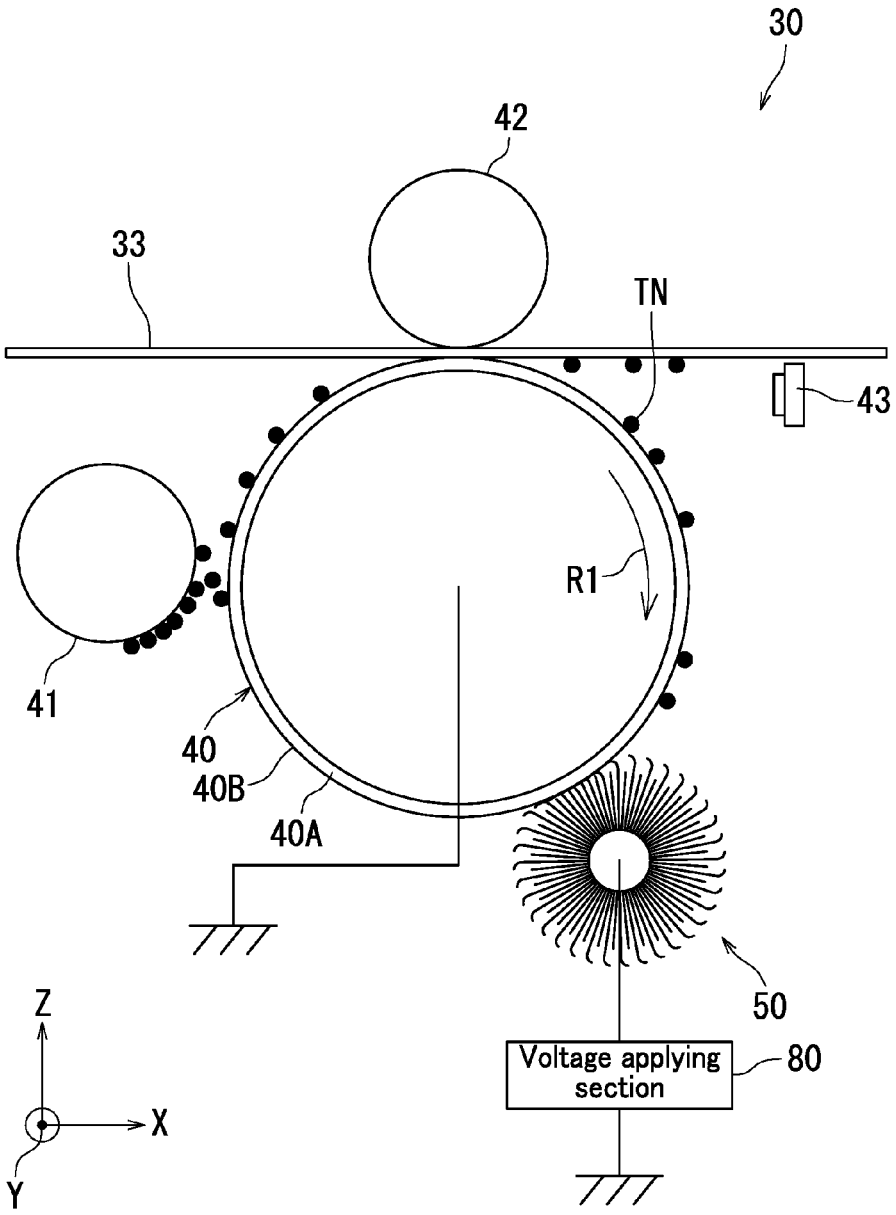
FIG. 2 is a side cross sectional view illustrating a part of an image forming section in FIG. 1.

A configuration of the image forming section 30 will be described next with reference to FIG. 2. FIG. 2 is a cross sectional view illustrating a part of the image forming section 30. The image forming section 30 further includes a voltage applying section 80 in addition to the photosensitive drum 40, the development roller 41, etc. The photosensitive drum 40 has a cylindrical shape and has a circumferential surface 40B on which a toner image is to be formed. The photosensitive drum 40 is earthed. The photosensitive drum 40 may be a positively chargeable organic photoconductor (OPC) drum, for example. The photosensitive drum 40 may alternatively be a negatively chargeable OPC drum. The photosensitive drum 40 includes a photosensitive layer 40A. The photosensitive layer 40A may be a single-layer type photosensitive layer or a multilayered type photosensitive layer. A positively chargeable single-layer type OPC drum is superior in abrasion resistance to a negatively chargeable multilayered type OPC drum. For this reason, the positively chargeable single-layer type OPC drum is preferably used. In the present embodiment, the photosensitive drum 40 is a positively chargeable single-layer type OPC drum.

The brush roller 50 is disposed opposite to the photosensitive drum 40. The brush roller 50 removes toner TN remaining on the circumferential surface 40B of the photosensitive drum 40, which may be referred simply to as "residual toner TN". Specifically, the brush roller 50 rotates while in contact with the circumferential surface 40B of the photosensitive drum 40 at a location downstream of the primary transfer roller 42 in terms of a rotation direction R1 of the photosensitive drum 40 to remove residual toner TN on the circumferential surface 40B of the photosensitive drum 40. In a situation in which foreign matter such as powder generated from a sheet P (for example, lumps of cellulose) is attached to the circumferential surface 40B of the photosensitive drum 40, the brush roller 50 can also remove the powder attached thereto. The toner TN and the foreign matter removed by the brush roller 50 are collected into a toner collecting vessel (not illustrated).

The voltage applying section 80 applies voltage between the photosensitive drum 40 and the brush roller 50. The voltage applying section 80 is earthed. For example, the earthed photosensitive drum 40 is positively chargeable in the present embodiment. As such, the voltage applying section 80 applies positive voltage to the brush roller 50. The voltage that the voltage applying section 80 applies will be described later in detail with reference to FIGS. 3A and 3B. Voltage application to the brush roller 50 by the voltage applying section 80 causes proximal discharge between the brush roller 50 and the circumferential surface 40B of the photosensitive drum 40. Through the above, the brush roller 50 charges the circumferential surface 40B of the photosensitive drum 40 (the surface of the photosensitive layer 40A). The proximal discharge is a phenomena caused in small space in the vicinity of the photosensitive drum 40.

After the circumferential surface 40B of the photosensitive drum 40 is charged by the brush roller 50, an electrostatic latent image is formed on the circumferential surface 40B of the photosensitive drum 40 by the exposure unit 31 (see FIG. 1). The development roller 41 then supplies toner to the circumferential surface 40B of the photosensitive drum 40. By toner supply, the toner is attached to the circumferential surface 40B of the photosensitive drum 40 in correspondence with the electrostatic latent image, thereby developing the electrostatic latent image. Through the above, a toner image is formed on the circumferential surface 40B of the photosensitive drum 40

The primary transfer roller 42 transfers the toner image formed on the circumferential surface 40B of the photosensitive drum 40 to the outer surface of the intermediate transfer belt 33. The charge eliminating lamp 43 removes charges remaining on the circumferential surface 40B of the photosensitive drum 40.

As described with reference to FIGS. 1 and 2, the brush roller 50 in the present embodiment charges the circumferential surface 40B of the photosensitive drum 40 and removes toner TN remaining on the circumferential surface 40B of the photosensitive drum 40. In the above configuration, it is needless to additionally provide a cleaning member (for example, a cleaning blade) for removing residual toner. Therefore, a charging efficiency and a toner removability can be attained by a simple configuration.

The photosensitive drum 40 in the present embodiment is an organic photosensitive drum including a single-layer type photosensitive layer 40A. The single-layer type OPC photosensitive layer 40A is excellent in abrasion resistance. Accordingly, the photosensitive drum 40 can be stably used for a long period of time. The single-layer type photosensitive layer 40A more readily allows electric current to flow in charging than a multilayered type photosensitive layer. As such, the brush roller 50 can stably cause proximal discharge. As a result, charging efficiency for the photosensitive drum 40 can be improved.

Figure 3A:
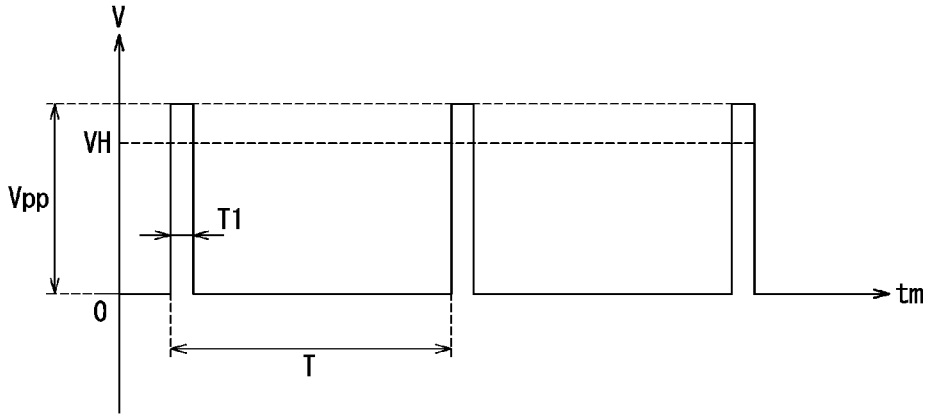
FIGS. 3A and 3B are graph representations each indicating voltage that a voltage applying section in FIG. 2 applies to a brush roller.
Figure 3B:
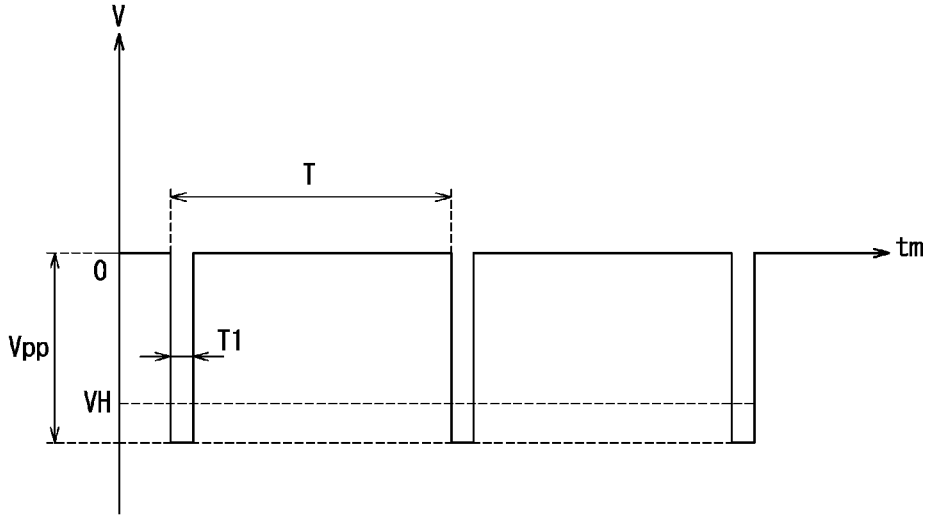

Following describes the voltage that the voltage applying section 80 applies with reference to FIGS. 3A and 3B. FIGS. 3A and 3B are graph representations each indicating voltage that the voltage applying section 80 can apply to the brush roller 50. In each of the graph representations, the vertical axis indicates voltage V and the horizontal axis indicates time tm.

The voltage applying section 80 applies voltage having a pulse waveform. As illustrated in FIGS. 3A and 3B, the pulses in the waveform are rectangular. The photosensitive drum 40 in the present embodiment, which is a positively chargeable single-layer type OPC drum, applies to the brush roller 50 voltage illustrated in FIG. 3A for positively charging the circumferential surface 40B of the photosensitive drum 40. In a configuration in which the photosensitive drum 40 is a negatively chargeable multilayered type OPC drum, the voltage applying section 80 applies to the brush roller 50 voltage illustrated in FIG. 3B for negatively charging the circumferential surface 40B of the photosensitive drum 40.

The voltage applied to the brush roller 50 has a voltage value (value of peak-to-peak voltage Vpp) of at least a preset threshold voltage VH. The preset threshold voltage VH is set to 1 kV, for example. Preferably, the preset threshold voltage VH is set to 3 kV, for example. The voltage applied to the brush roller 50 has a frequency (1/T) of at least a preset threshold frequency. The preset threshold frequency is set to 2 kHz, for example. Preferably, the preset threshold frequency is set to 3 kHz, for example. The duty cycle (T1/T) of the rectangular waveform is no greater than a preset threshold duty cycle. The preset threshold duty cycle is set to 10%, for example. Preferably, the preset threshold duty cycle is set to 1%. The voltage applying section 80 may apply bias voltage to the brush roller 50 as necessary. By applying the bias voltage, a time taken for voltage rise can be shortened.

As described with reference to FIGS. 2, 3A, and 3B, the voltage applying section 80 in the present embodiment applies voltage having the rectangular pulse waveform (rectangular waveform) between the photosensitive drum 40 and the brush roller 50. The voltage value of the voltage is set to at least the preset threshold voltage VH. The frequency of the voltage is set to at least the preset threshold frequency. Under the above conditions, proximal discharge is caused between the brush roller 50 and the photosensitive drum 40. As a result, the photosensitive drum 40 can be charged effectively.

The duty cycle of the rectangular waveform is no greater than the preset threshold duty cycle in the present embodiment. By setting the duty cycle as above, charging efficiency for the photosensitive drum 40 can be improved.

Figure 4A:
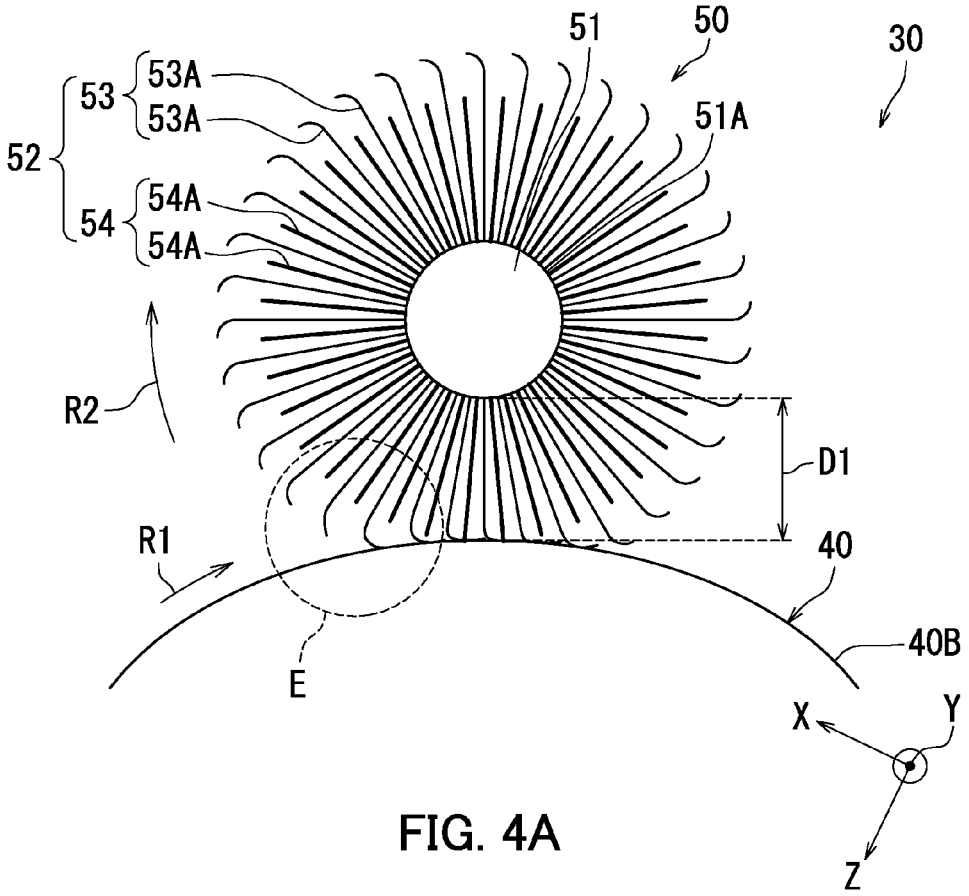
FIG. 4A is a side cross sectional view illustrating a part of the image forming section in FIG. 1.
Figure 4B:
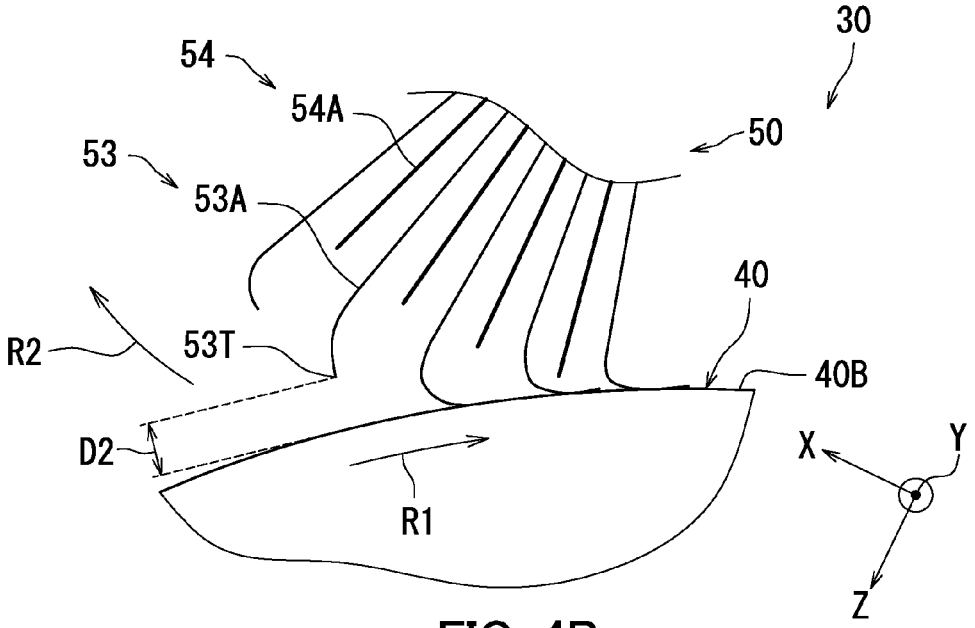
FIG. 4B is an enlarged partial view of the image forming section in FIG. 4A.

Following describes a configuration of the brush roller 50 with reference to FIGS. 4A and 4B. FIG. 4A is a side cross sectional view illustrating a part of the image forming section 30. FIG. 4B is an enlarged partial view of the image forming section 30 in FIG. 4A (an enlarged view illustrating a part encircled by a broken line E). The brush roller 50 includes a shaft 51 and a brush portion 52. The shaft 51 is a cylindrical or columnar member located at the center of the brush roller 50. The shaft 51 has satisfactory rigidity. The shaft 51 may be made from a metal, for example. Examples of metals that can be used include sulfur free-cutting steels (SUM (steel, use, machinability)) and alloy steels for machine structural use (SCM (steel, chromium, molybdenum)). The shaft 51 has a diameter of 6 mm, for example. The brush roller 50 rotates about the shaft 51 as a rotational axis. A distance D1 between a circumferential surface 51A of the shaft 51 and the circumferential surface 40B of the photosensitive drum 40 is 1.5 mm, for example.

The brush portion 52 is disposed around the circumferential surface 51A of the shaft 51. The brush portion 52 includes a first brush 53 and a second brush 54. The first brush 53 includes a plurality of first bristles 53A. The second brush 54 includes a plurality of second bristles 54A. The first and second bristles 53A and 54A each have a base end mounted on the circumferential surface 51A of the shaft 51. For example, the respective based ends of the first and second bristles 53A and 54A are planted in the circumferential surface 51A of the shaft 51. The first brush 53 has a density of 300 kF/inch$^2$, for example. The second brush 54 has a density of 50 kF/inch$^2$, for example. The unit "kF/inch$^2$" represents the number of bristles per square inch where k represents 1,000 F.

The first bristles 53A are longer than the second bristles 54A. Specifically, the first bristles 53A are greater in length than the distance D1. The second bristles 53B are greater in length than the distance D1 and shorter than the first bristles 53A. The length of the first bristles 53A is 2.5 mm, for example. The length of the second bristles 54A is 2.0 mm, for example.

The first bristles 53A are thinner than the second bristles 54A. The thickness of the first bristles 53A is 2 denier, for example. The thickness of the second bristles 54A is 8 denier, for example. The unit "denier" represents a mass (gram) of bristles per 9,000 m.

The first bristles 53A are each made from a first material having conductivity. An example of the first material is nylon with which carbon or a metal is mixed to be conductive. Alternatively, the surfaces of the first bristles 53A may each be coated with carbon or a metal. The first bristles 53A have a resistance of no greater than $1\times10^4\Omega$, for example. In other words, the first material of the first bristles 53A is selected so that the first bristles 53A have a resistance of no greater than $1\times10^4\Omega$. In the above configuration, conductivity of the first bristles 53A can be improved so that proximal discharge can be readily caused.

The second bristles 54A are each made from a second material different from the first material. The second material may be nylon having no conductivity (nylon having insulating property), for example. Alternatively, the second material may have conductivity. The second bristles 54A have a resistance of $1\times10^{10}\Omega$, for example. In a configuration in which the surfaces of the second bristles 54A are each coated with a metal or the like or an abrasive is mixed with the second material of the second bristles 54A, stiffness of the second bristles 54A can be improved.

The brush roller 50 is driven by a drive section (not illustrated) to rotate in a direction (hereinafter referred to as a counter rotation direction) R2 that is the same direction as a rotation direction R1 of the photosensitive drum 40. Difference in peripheral speed between the photosensitive drum 40 and the brush roller 50 is 240 mm/sec., for example. The brush roller 50 charges the circumferential surface 40B of the photosensitive drum 40 by proximal discharge while rotating in the counter rotation direction R2 relative to the photosensitive drum 40.

As illustrated in FIG. 4B, the first bristles 53A each have a curved tip end portion 53T that faces (or inclines) toward the circumferential surface 40B of the photosensitive drum 40 when located at a specific location. The specific location is a location of the curved tip end portion 53T of a first bristle 53A after coming into contact with the circumferential surface 40B of the photosensitive drum 40 that is a predetermined distance D2 apart from the circumferential surface 40B of the photosensitive drum 40. The predetermined distance D2 may be from 10 μm to 100 μm, for example. As described with reference to FIGS. 3A and 3B, the voltage applying section 80 applies the voltage having the rectangular waveform at a duty cycle of no greater than the preset threshold duty cycle. The curved tip end portions 53T of the first bristles 53A each face toward the circumferential surface 40B of the photosensitive drum 40 when located at the specific location. In the above configuration, proximal discharge can be caused further efficiently to the circumferential surface 40B of the photosensitive drum 40.

As described with reference to FIGS. 4A and 4B, the first bristles 53A in the present embodiment are made from the first material having conductivity. In the above configuration, proximal discharge can be caused readily.

The first bristles 53A are longer than the second bristles 54A in the present embodiment. In the above configuration, the first bristles 53A can readily come in contact with the circumferential surface 40B of the photosensitive drum 40. As a result, the circumferential surface 40B of the photosensitive drum 40 can be uniformly charged.

The first bristles 53A are thinner than the second bristles 54A in the present embodiment. In the above configuration, the first brush 53 can efficiently cause proximal discharge from the curved tip end portions 53T of the first bristles 53A. As a result, charging efficiency for the photosensitive drum 40 can be improved.

The second material of the second bristles 54A has an insulating property in the present embodiment. In the above configuration, a situation in which residual toner TN is attached to and remains on the second bristles 54A can be prevented in removal of residual toner TN on the circumferential surface 40B of the photosensitive drum 40 by the second bristles 54A remove.

The brush roller 50 is driven to rotate in the counter rotation direction R2 relative to the rotation direction R1 of the photosensitive drum 40. In the above configuration, relative speed of the first brush 53 at the curved tip end portions 53T of the first bristles 53A can be increased relative to the circumferential surface 40B of the photosensitive drum 40. The above configuration can increase the number of times of discharge per unit time from the curved tip end portions 53T of the first bristles 53A toward the circumferential surface 40B of the photosensitive drum 40. Furthermore, the curved tip end portions 53T of the first bristles 53A each face toward the circumferential surface 40B of the photosensitive drum 40 when located at the specific location. In the above configuration, efficient discharge can be caused from the curved tip end portions 53T of the first bristles 53A toward the circumferential surface 40B of the photosensitive drum 40. As a result, the photosensitive drum 40 can be charged further uniformly.

Figure 5:
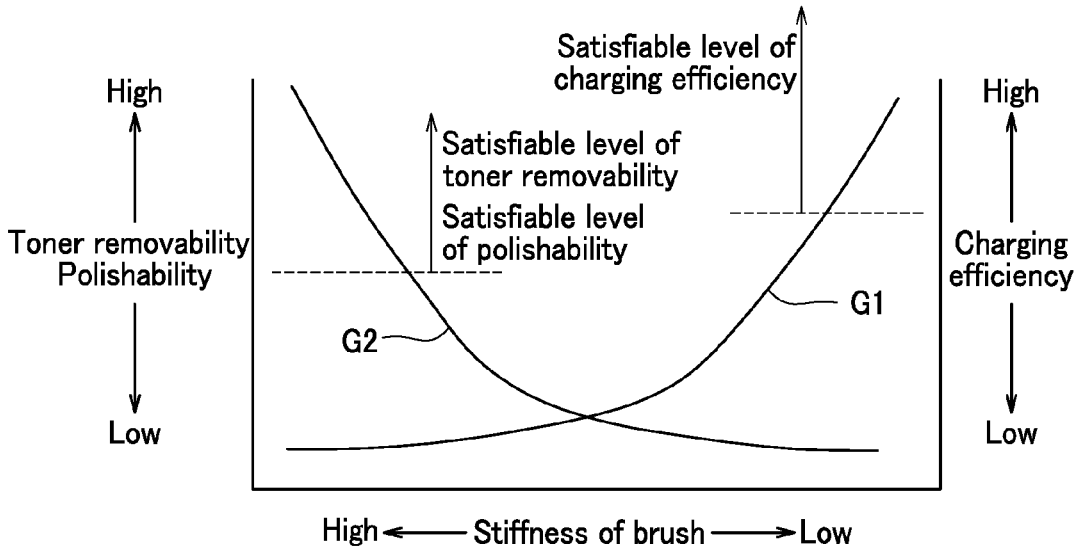
FIG. 5 is a graph representation indicating a relationship between stiffness, charging efficiency, toner removability, and polishability of a brush.

Following describes a relationship between stiffness, charging efficiency, toner removability, and polishability of a brush with reference to FIG. 5. FIG. 5 is a graph representation indicating the relationship between stiffness, charging efficiency, toner removability, and polishability of the brush. The vertical axis indicates each level of charging efficiency, the toner removability, and the polishability, while the horizontal axis indicates level of the stiffness of the brush. A curve G1 indicates variation in the charging efficiency depending on the stiffness of the brush. A curve G2 indicates respective variations in the toner removability and the polishability depending on the stiffness of the brush.

The polishability of bristles means ability of bristles to polish off deposit deposited on the circumferential surface of a photosensitive drum and a degrading part of the circumferential surface thereof. Repetitive use of the photosensitive drum may cause deposition of deposit (for example, an external additive of a toner and residual toner) on the circumferential surface of the photosensitive drum. Charging the photosensitive drum generates an ionized material. The ionized material may cause partial degradation of the circumferential surface of the photosensitive drum. As a result, cleaning failure may be caused to cause to instability of image formation.

Typically, the stiffness of a brush depends on thickness and hardness of bristles thereof, for example. The greater the thickness and hardness of the bristles, the higher the stiffness of the brush. By contrast, the less the thickness and hardness of the bristles, the lower the stiffness of the brush.

As the stiffness of the brush is increased, the charging efficiency of the brush decreases as indicated by the curve G1 while the polishability and the toner removability of the brush increase as indicated by the curve G2. In contrast, as the stiffness of the brush is decreased, the charging efficiency of the brush increases as indicated by the curve G1 while the polishability and the toner removability of the brush decrease as indicated by the curve G2. In other words, it is difficult for a brush including a single type of bristles to increase charging efficiency, polishability, and toner removability of the brush.

By contrast, the brush roller 50 in the present embodiment includes two types of bristles. Specifically, the second brush 54 has higher stiffness than the first brush 53, as described with reference to FIGS. 4A and 4B. In the above configuration, the first brush 53 having low stiffness can attain charging efficiency while the second brush 54 having high stiffness can attain polishability and toner removability.

As described with reference to FIGS. 4A, 4B, and 5, the second brush 54 has higher stiffness than the first brush 53 in the present embodiment. In the above configuration, polishability for the photosensitive drum 40 and removability for residual toner TN can be improved.

Figure 6A:
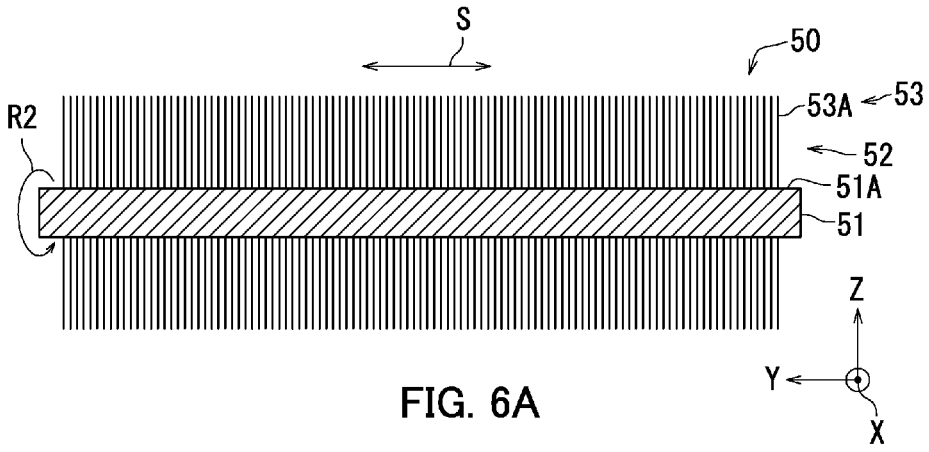
FIG. 6A is a side cross sectional view illustrating a first brush of the brush roller in FIGS. 4A and 4B.
Figure 6B:
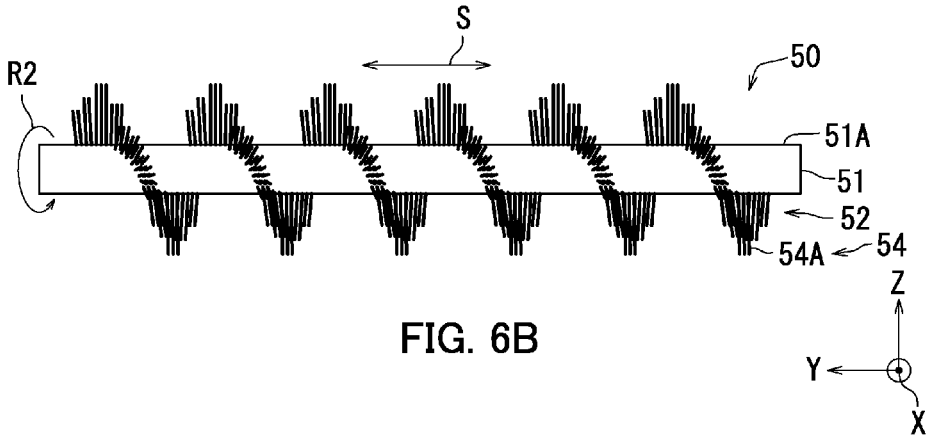
FIG. 6B is a side view illustrating a second brush of the brush roller in FIGS. 4A and 4B.
Figure 6C:
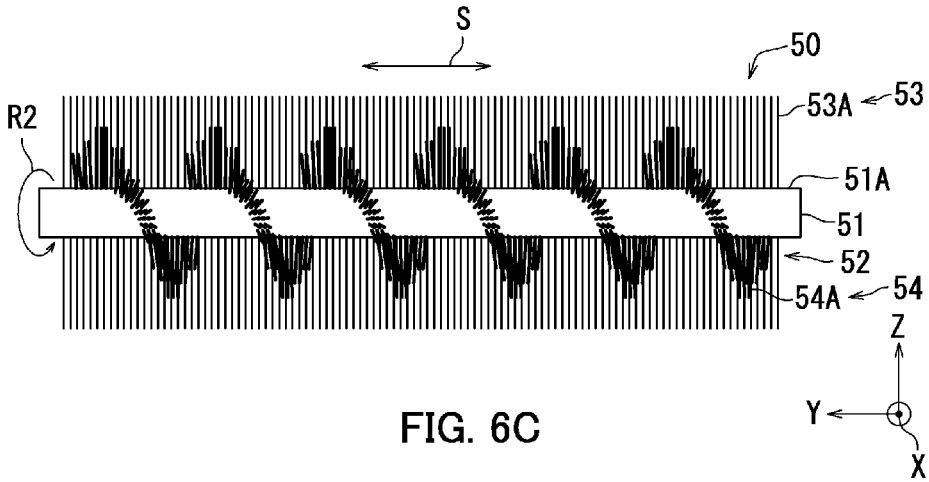
FIG. 6C illustrates the brush roller illustrated in FIGS. 4A and 4B.

Following describes arrangement of the first and second brushes 53 and 54 with reference to FIGS. 6A-6C. FIG. 6A is a side cross sectional view illustrating the first brush 53. FIG. 6B is a side view illustrating the second brush 54. FIG. 6C illustrates the brush roller 50. The second brush 54 is omitted in FIG. 6A for the sake of easy understanding of the configuration of the first brush 53. The first brush 53 is omitted in FIG. 6B for the sake of easy understanding of the configuration of the second brush 54. For the sake of convenience, the first brush 53 is illustrated in cross section while the second brush 54 is illustrated as viewed from a side in the brush portion 52 in FIG. 6C.

As illustrated in FIG. 6A, the first bristles 53A of the first brush 53 are mounted on all over the circumferential surface 51A of the shaft 51 other than opposite end portions of the shaft 51 such that the first brush 53 has a specific density. The first brush 53 is disposed around the circumferential surface 51A of the shaft 51 in a point-symmetrical manner about the rotational axis of the brush roller 50 in cross section perpendicular to the rotational axis of the brush roller 50. In other words, a region where the first bristles 53A are mounted is located on the entire circumferential surface 51A of the shaft 51 in cross section. By increasing the density of the first brush 53, uniform charging can be achieved.

As illustrated in FIG. 6B, the second brush 54 is disposed helically on the circumferential surface 51A of the shaft 51. Specifically, the second bristles 54A of the second brush 54 are mounted on the circumferential surface 51A of the shaft 51 other than the opposite end portions of the shaft 51 in a helical manner such that the second brush 54 has a specific density and a specific width. The second brush 54 is preferably disposed on the circumferential surface 51A of the shaft 51 in a non-point-symmetrical manner about the rotational axis of the brush roller 50 in cross section perpendicular to the rotational axis of the brush roller 50. In other words, a region where the second bristles 54A are mounted is located in a part of the circumferential surface 51A of the shaft 51 in the cross section. The brush roller 50 illustrated in FIG. 6C rotates in the counter rotation direction R2 while in contact with the circumferential surface 40B of the photosensitive drum 40. In the above configuration, the second brush 54 moves residual toner TN remaining on the circumferential surface 40B of the photosensitive drum 40 in an axial direction S of the photosensitive drum 40.

As described with reference to FIGS. 6B and 6C, the second brush 54 is disposed helically on the circumferential surface 51A of the shaft 51 in the present embodiment. In the above configuration, the second brush 54 moves residual toner TN remaining on the circumferential surface 40B of the photosensitive drum 40 in the axial direction S of the photosensitive drum 40. As a result, an amount of residual toner TN remaining on the circumferential surface 40B of the photosensitive drum 40 can be reduced.

Figure 7:
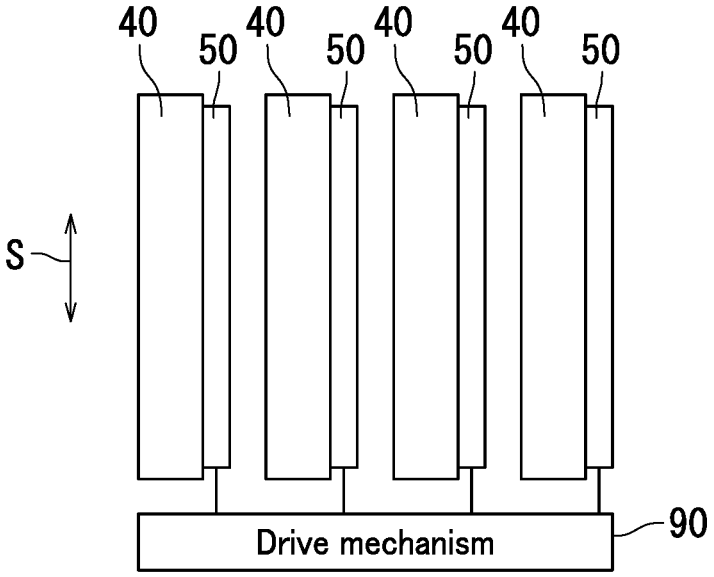
FIG. 7 is a schematic diagram illustrating a drive mechanism for the brush roller in FIGS. 4A and 4B.

Following describes a sliding operation of the brush roller 50 with reference to FIG. 7. FIG. 7 is a schematic diagram illustrating a part of the image forming section 30. The image forming apparatus 1 further includes a drive mechanism 90.

The drive mechanism 90 causes the brush roller 50 to reciprocally move in an axial direction S of the photosensitive drum 40. The drive mechanism 90 includes for example gears, cams, and a power supply such as a motor. The photosensitive drum 40 is fixed to a housing of the image forming apparatus 1, for example. The distance where the brush roller 50 reciprocally moves is 2 mm per 10 rotations to 2 mm per one rotation, for example. Reciprocal movement of the brush roller 50 moves deposit deposited on the brush portion 52 in the axial direction S of the photosensitive drum 40.

As described with reference to FIG. 7, the drive mechanism 90 causes the brush roller 50 to reciprocally move in the axial direction S of the photosensitive drum 40 in the present embodiment. In the above configuration, a situation in which residual toner TN on the circumferential surface 40B of the photosensitive drum 40 remains locally can be prevented. As a result, residual toner TN can be removed uniformly.

The embodiment of the present disclosure has been described so far with reference to the drawings (FIGS. 1-7). The present disclosure is not limited to the specific embodiment described above and can be practiced in various ways within the scope not departing from the essence of the present disclosure (for example, the following (1) to (4)). Various alterations are possible by appropriately combining the elements in the above embodiment. For example, several elements in the above embodiment can be removed from the overall configuration. The drawings are schematic illustrations that emphasize elements of configuration in order to facilitate understanding thereof. Therefore, thickness, length, the number, distance, etc. of each of the elements in the drawings may differ from actual ones of the elements for the sake of illustration convenience. Further, the properties of each of the elements, such as speed, material, shape, and dimension thereof described in the above embodiment are mere examples and not limited specifically. The properties of the elements can be altered in various manners within the scope not substantially departing from the features of the present disclosure.

(1) As illustrated in FIGS. 4A and 4B, the brush roller 50 is driven to rotate in the counter rotation direction R2 relative to the rotation direction R1 of the photosensitive drum 40, which however should not be taken to limit the present disclosure. Alternatively, for example, the brush roller 50 may be driven to rotate in a direction opposite to the rotation direction R1 of the photosensitive drum 40. In a configuration in which the peripheral speed of the photosensitive drum 40 is higher than that of the brush roller 50 in the above alternative example, the curved tip end portion 53T of each first bristle 53A preferably faces (inclines) toward the circumferential surface 40B of the photosensitive drum 40 when located at a specific location before coming into contact with the circumferential surface 40B of the photosensitive drum 40. In the above configuration, the brush roller 50 can effectively charge the photosensitive drum 40.

(2) The voltage applying section 80 works in image formation in the present embodiment. However, the voltage applying section 80 may work before and after image formation. Specifically, before the image forming section 30 starts image formation, the voltage applying section 80 preferably applies positive bias voltage and negative bias voltage to the brush roller 50. For example, the voltage applying section 80 continues applying the positive bias voltage during 2 rotations of the brush roller 50 and then continues applying the negative bias voltage during 2 rotations of the brush roller 50. In the above configuration, toner attached to the brush roller 50 can be easily removed. Preferably, the brush roller 50 thereafter discharges toward the brush roller 50 during additional 3 rotations of the brush roller 50. In the above configuration, the brush roller 50 can stably charge the photosensitive drum 40. Preferably, the voltage applying section 80 continues applying positive and negative bias voltages to the brush roller 50 during respective 2 rotations of the brush roller 50 even after completion of image formation by the image forming section 30. In the above configuration, toner attached to the brush roller 50 can be easily removed.

(3) As described with reference to FIG. 7, the drive mechanism 90 causes the brush roller 50 to reciprocally move in the axial direction S of the photosensitive drum 40, which however should not be taken to limit the present embodiment. Alternatively, for example, the drive mechanism 90 may cause the photosensitive drum 40 to reciprocally move in the axial direction S of the photosensitive drum 40. The distance where the photosensitive drum 40 moves reciprocally may be 0.5 mm per 250 rotations to 0.5 mm per 14 rotations, for example. Reciprocal movement of the photosensitive drum 40 can prevent local deposition of deposit on the circumferential surface 40B of the photosensitive drum 40.

(4) The photosensitive drum 40 illustrated in FIG. 2 is earthed, which however should not be taken to limit the present disclosure. For example, the photosensitive drum 40 may not be earthed in a configuration in which the brush roller 50 is earthed. In the above configuration, the voltage applying section 80 may apply voltage to the photosensitive drum 40.

What is claimed is:

1. An image forming apparatus comprising:

a photosensitive drum having a circumferential surface on which a toner image is to be formed; and a brush roller configured to rotate while in contact with the circumferential surface of the photosensitive drum to charge the photosensitive drum, wherein the brush roller removes toner remaining on the circumferential surface of the photosensitive drum, the brush roller includes a shaft and a brush portion disposed around the shaft, the brush portion includes a first brush including first bristles and a second brush including second bristles, the first bristles each being made from a first material having conductivity, the second bristles each being made from a second material different from the first material, and the first bristles are longer than the second bristles.

2. The image forming apparatus according to claim 1, wherein the second brush has higher stiffness than the first brush.

3. The image forming apparatus according to claim 1, wherein the second brush is disposed helically on a circumferential surface of the shaft of the brush roller.

4. The image forming apparatus according to claim 1, wherein the brush roller is driven to rotate in a direction that is same as a rotation direction of the photosensitive drum, and the first bristles each have a curved tip end portion that faces toward the circumferential surface of the photosensitive drum when located at a specific location, the specific location being a location of the curved tip end portion after coming into contact with the circumferential surface of the photosensitive drum that is a predetermined distance apart from the circumferential surface of the photosensitive drum.

5. The image forming apparatus according to claim 1, wherein the photosensitive drum has a single-layer type organic photosensitive layer.

6. The image forming apparatus according to claim 1, wherein the first bristles are greater in length than a distance between the circumferential surface of the shaft and the circumferential surface of the photosensitive drum, the second bristles are greater in length than the distance between the circumferential surface of the shaft and the circumferential surface of the photosensitive drum and shorter than the first bristles, and the second bristles each have an insulating property.

7. The image forming apparatus according to claim 1, wherein in cross section perpendicular to a rotational axis of the brush roller, the first brush is disposed around the circumferential surface of the shaft in a point-symmetric manner about the rotational axis of the brush roller, and the second brush is disposed on the circumferential surface of the shaft in a non-point-symmetrical manner about the rotational axis of the brush roller.

8. An image forming apparatus comprising:

a photosensitive drum having a circumferential surface on which a toner image is to be formed; and a brush roller configured to rotate while in contact with the circumferential surface of the photosensitive drum to charge the photosensitive drum, wherein the brush roller removes toner remaining on the circumferential surface of the photosensitive drum, and the image forming apparatus further comprises a drive mechanism configured to cause the brush roller to reciprocally move in an axial direction of the photosensitive drum.

9. An image forming apparatus comprising:

a photosensitive drum having a circumferential surface on which a toner image is to be formed; and a brush roller configured to rotate while in contact with the circumferential surface of the photosensitive drum to charge the photosensitive drum, wherein the brush roller removes toner remaining on the circumferential surface of the photosensitive drum, the image forming apparatus further comprises a voltage applying section configured to apply voltage between the photosensitive drum and the brush roller, the voltage has a voltage value of at least a preset threshold voltage, and the voltage has a frequency of at least a preset threshold frequency.

10. The image forming apparatus according to claim 9, wherein the voltage that the applying section applies has a rectangular waveform, and the rectangular waveform has a duty ratio of at least a preset threshold value.

* * * * *